US005700140A

United States Patent [19]

Gray et al.

[11] Patent Number: 5,700,140

[45] Date of Patent: Dec. 23, 1997

[54] PUMP WITH IMPROVED BEARING ARRANGEMENT FOR AXIAL POSITION CONTROL

[75] Inventors: James Delwin Gray, Bethany; Michael Franklin Hughes, Oklahoma City; Paul Joseph Lutes, Edmond, all of Okla.

[73] Assignee: Corken, Inc., Oklahoma City, Okla.

[21] Appl. No.: 642,678

[22] Filed: May 3, 1996

[51] Int. Cl.[6] ..... F04C 2/344; F04C 15/00

[52] U.S. Cl. ..... 418/104; 418/259; 418/270

[58] Field of Search ..... 418/104, 257, 418/259–270; 384/455

[56] References Cited

U.S. PATENT DOCUMENTS

| | | | |
|---|---|---|---|
| D. 294,265 | 2/1988 | Gray | D15/7 |
| 939,269 | 11/1909 | Killian | 384/455 |
| 2,118,760 | 5/1938 | Ernst | 384/455 |
| 2,453,182 | 11/1948 | Bechler | 384/248 |
| 2,902,943 | 9/1959 | Fuerst et al. | 418/269 |
| 3,580,420 | 5/1971 | Kennedy et al. | 222/1 |
| 3,633,406 | 1/1972 | Helms | 73/45.4 |
| 3,805,827 | 4/1974 | Kennedy et al. | 137/516.17 |
| 3,811,792 | 5/1974 | Kennedy, Jr. | 417/28 |
| 4,027,880 | 6/1977 | Hadtke | 273/29 A |
| 4,132,237 | 1/1979 | Kennedy et al. | 137/75 |
| 4,169,254 | 9/1979 | Kennedy et al. | 337/409 |
| 4,465,446 | 8/1984 | Nemit, Jr. et al. | 418/201.1 |
| 4,659,298 | 4/1987 | Bryam et al. | 418/257 |
| 4,746,280 | 5/1988 | Wystemp et al. | 418/268 |
| 4,830,593 | 5/1989 | Byram et al. | 418/258 |
| 5,400,259 | 3/1995 | Murphy et al. | 364/474.2 |
| 5,431,552 | 7/1995 | Schuller et al. | 418/268 |

FOREIGN PATENT DOCUMENTS

| | | | |
|---|---|---|---|
| 853180 | 11/1939 | France | 418/270 |
| 156842 | 8/1932 | Switzerland | 418/270 |

OTHER PUBLICATIONS

New Medium–Capacity Screw Compressors for the Supply of Oil–Free Air, Hydraulics and Pneumatics, vol. 31, No. 9, Sep. 1970, 418–270.

*Primary Examiner*—John J. Vrablik

*Attorney, Agent, or Firm*—Hill, Steadman & Simpson

[57] ABSTRACT

A bearing arrangement for a pump is adapted for controlling thrust loads and limiting undesirable axial movement of components. The pump has a shaft having first and second shaft ends, and the pump may be configured so that the shaft is drivable from one or both of the shaft ends. The first and second shaft ends are respectively supported in a first and second bearing arrangement. Each bearing arrangement includes a radial main bearing having an inner race disposed around the shaft end. The inner race contacts a mounting ring to transfer outwardly axial thrust forces against a thrust bearing assembly. Each bearing arrangement is retained by a bearing cap contacting against an outer side of the thrust bearing assembly. A shim having a selected thickness can be placed between the bearing cap and the housing in order to position the internal pump components in an axially centered position to maintain proper clearances in order to minimize wear.

23 Claims, 4 Drawing Sheets

PUMP WITH IMPROVED BEARING ARRANGEMENT FOR AXIAL POSITION CONTROL

BACKGROUND OF THE INVENTION

This invention generally relates to a bearing arrangement in a pump, and more particularly relates to a pump shaft bearing assembly that limits unwanted axial movement caused by drive line thrust loads.

Vane pumps can be used in many fluid transfer applications and are especially applicable in the transfer of fluids that must be stored and transferred in closed tankage and piping systems at or above their respective vapor pressures to be contained in the liquid state, such as propane, carbon dioxide, and ammonia. By nature of their internal geometry, vane pumps require main bearings designed to the radial shaft loads produced by the hydraulic pumping forces and torque produced by a properly installed drive and prime mover.

In applications where the conventional drive systems cannot be effectively used, such as on a tanker truck, provision must be made at the pump drive shaft to protect the pumping mechanism from the unpredictable axial forces of rigid drive line couplings typical of U-joint drives and axial forces produced by some flexible coupling devices.

Therefore, a need exists for an improved bearing arrangement in a fluid transfer vane pump which handles axial thrust loads from prime mover drive lines.

SUMMARY OF THE INVENTION

In order to enhance a known pump's capability to accept all possible radial and axial forces produced by prime movers (i.e., power take-off drives), the present invention provides a pump with an improved bearing arrangement to locate and protect the pumping components. The pump has a housing within which a shaft is rotationally disposed. The shaft has opposed ends, and the present invention provides embodiments wherein the shaft is configured to have either one or two driving ends. In either embodiment, the shaft is rotationally supported at each opposed end; pumping components, such as the rotor and vanes, are secured between the shaft ends. The improved bearing arrangement includes first and second bearing assemblies at each of the opposed ends and which rotationally and axially support the pumping components.

Each bearing assembly has a main radial bearing with an inner race secured to the shaft. A mounting ring slips over the shaft and adjacently contacts the inner race of the main radial bearing. A thrust bearing assembly has an inner and outer thrust washer that contain the axial bearing which contacts against the mounting ring and the bearing caps. The thrust bearing receives axial thrust loads and limits axial movement of the pumping components.

First and second bearing caps are secured to the housing for supporting respective bearing arrangements. The bearing caps are secured at opposite ends of the housing heads adjacent to the first and second thrust bearings, respectively. Each bearing cap retains the respective thrust bearing against its mounting ring.

According to an aspect of the invention, first and second shims may be provided, each shim being disposed between the respective bearing caps and housing heads. Each shim has a selected thickness to generally center pumping components within the housing. A related advantage of the pump is that the axial position of the internal pumping components can be closely set to prevent unwanted wear.

In an embodiment, first and second outer shaft seals are provided. The first and second outer shaft seals are disposed in the first and second bearing caps, respectively. Each outer shaft seal is sealably disposed around the shaft.

In an embodiment, first and second seal assemblies are sealably disposed around the shaft between the internal pumping components and the respective bearing assemblies.

In an embodiment, a lubrication cavity extends between the thrust bearing assembly and the main radial bearing.

During pump use, axial thrusts may be introduced to the pump via flexible couplings or by the rigid mounting of the power-take-off coupling to the pump shaft. The axial thrust bearing assembly of the present invention is designed to transfer the axial thrust force through the shaft and opposite main radial bearing inner race and axial bearing mounting ring via contact with the outer circumference of the inner bearing race. The thrust bearing assembly is mounted transversely to the longitudinal axis to allow continued rotation of the shaft. The thrust bearing assembly allows the inner thrust washer to rotate with the pump shaft and thrust bearing mounting ring while the outer thrust washer remains static with the bearing cap. The thrust bearings roll at one-half the speed of the pump shaft. The thrust bearing assembly limits axial internal movement generated by axial thrusts while maintaining the necessary internal pumping component clearances. Unwanted wear from internal pumping component contact is prevented.

Therefore, an advantage of the present invention is to provide an improved bearing arrangement. More specifically, an advantage of the present invention is to provide an improved bearing arrangement for a vane pump which limits axial movement of internal components generated by thrust forces. A related advantage is to reduce friction between wear surfaces within the pump.

Another advantage of the present invention is to provide an improved bearing arrangement which absorbs axial thrust forces from each axial direction along the shaft of a pump, the bearing assembly being applicable to a pump having either a single or double-ended drive shaft configuration.

A further advantage of the present invention is to provide axial adjustability of the bearing arrangements in order to center the pump components for reducing wear.

Additional features and advantages of the present invention are described in, and will be apparent from, the Detailed Description of the Presently Preferred Embodiments and from the drawings.

DETAILED DESCRIPTION OF THE PRESENTLY PREFERRED EMBODIMENTS

Figure 1:
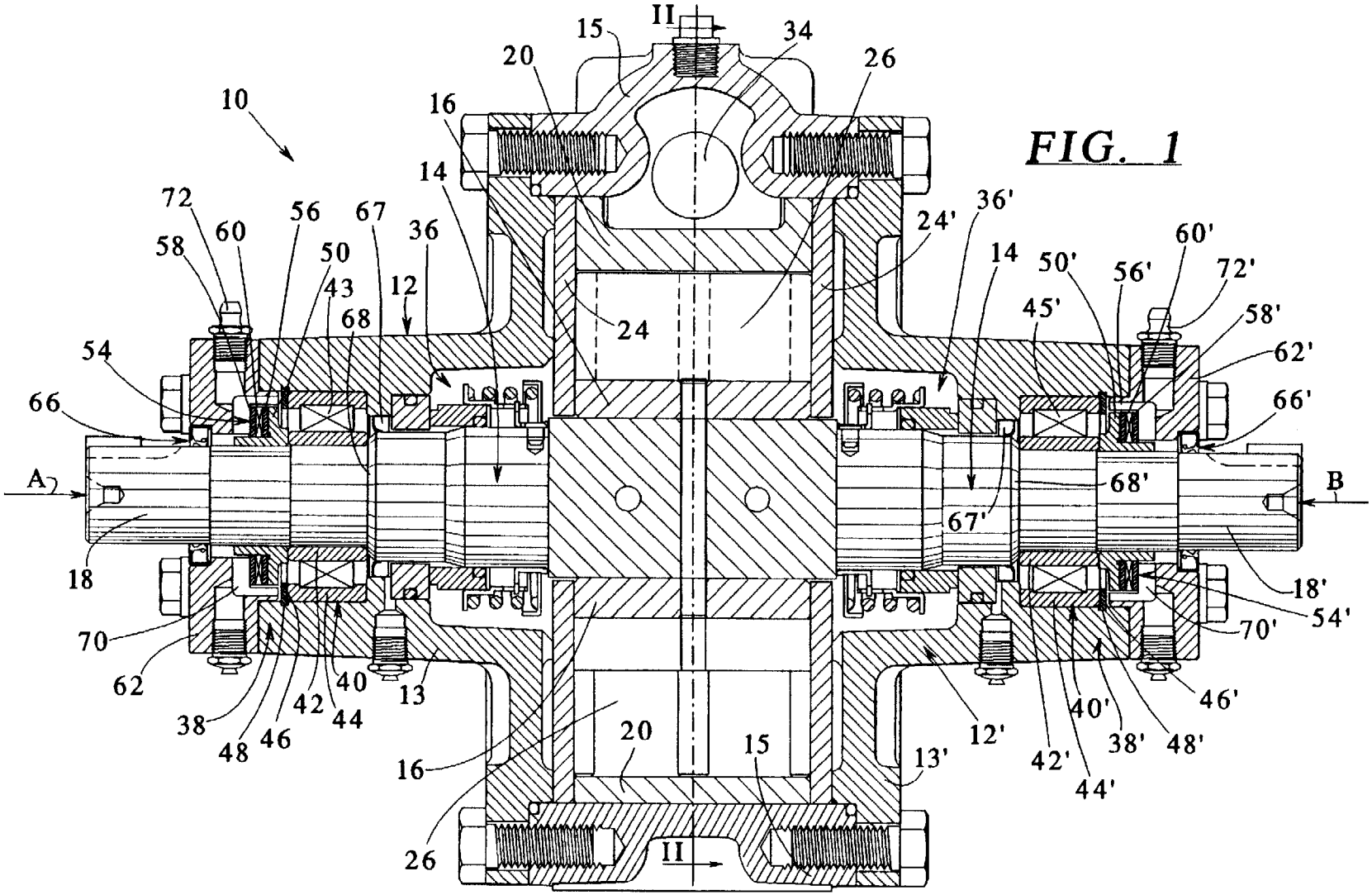
FIG. 1 is a sectional view of an embodiment of a vane pump according to the present invention, wherein the pump has a shaft with two driving ends, the section being taken generally along line I—I of FIG. 2.
Figure 3:
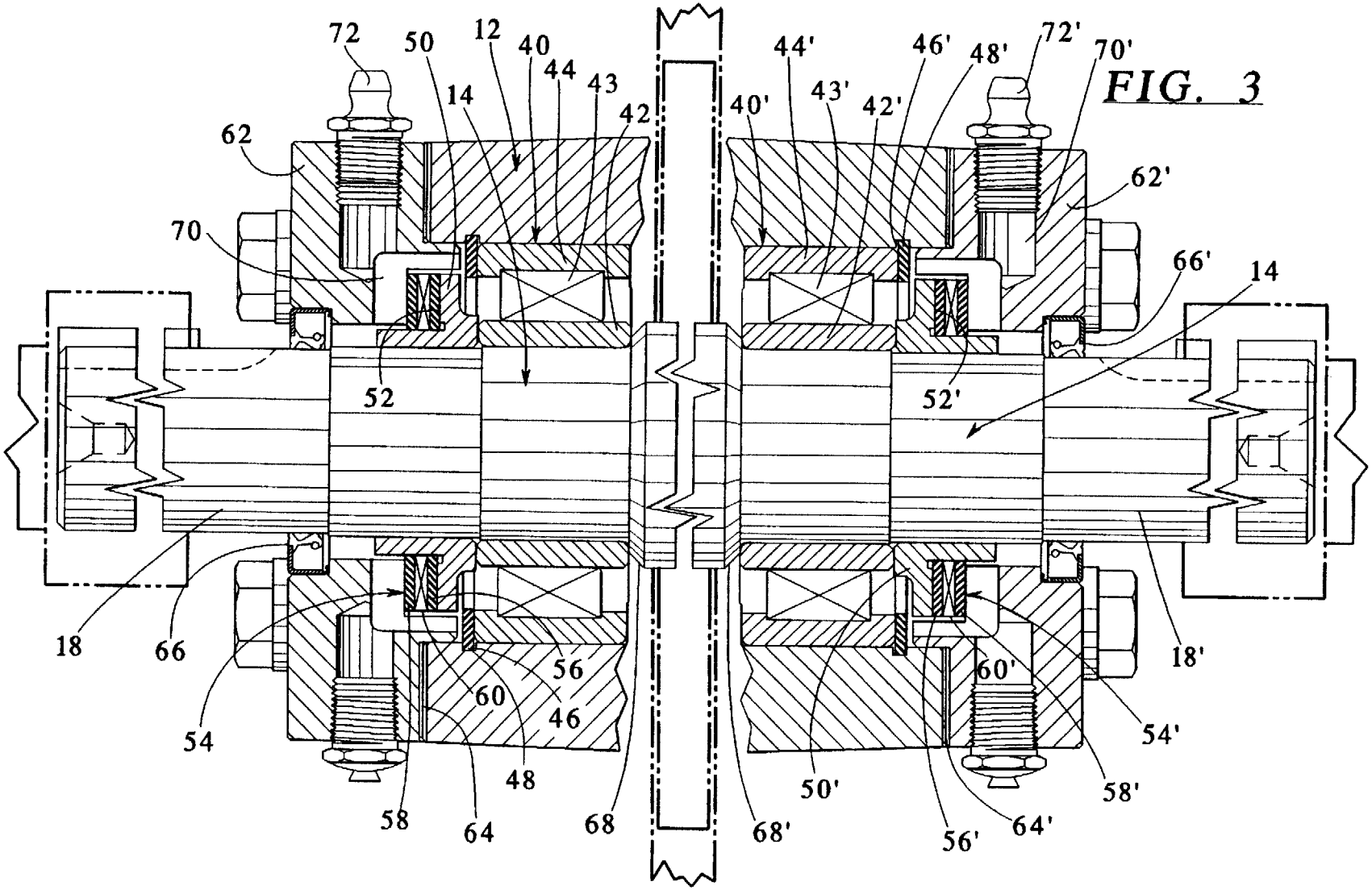
FIG. 3 is a fragmentary sectional view also taken generally along line I—I of FIG. 2, showing enlarged illustrations of the bearing arrangements of the pump of FIG. 1.
Figure 4:
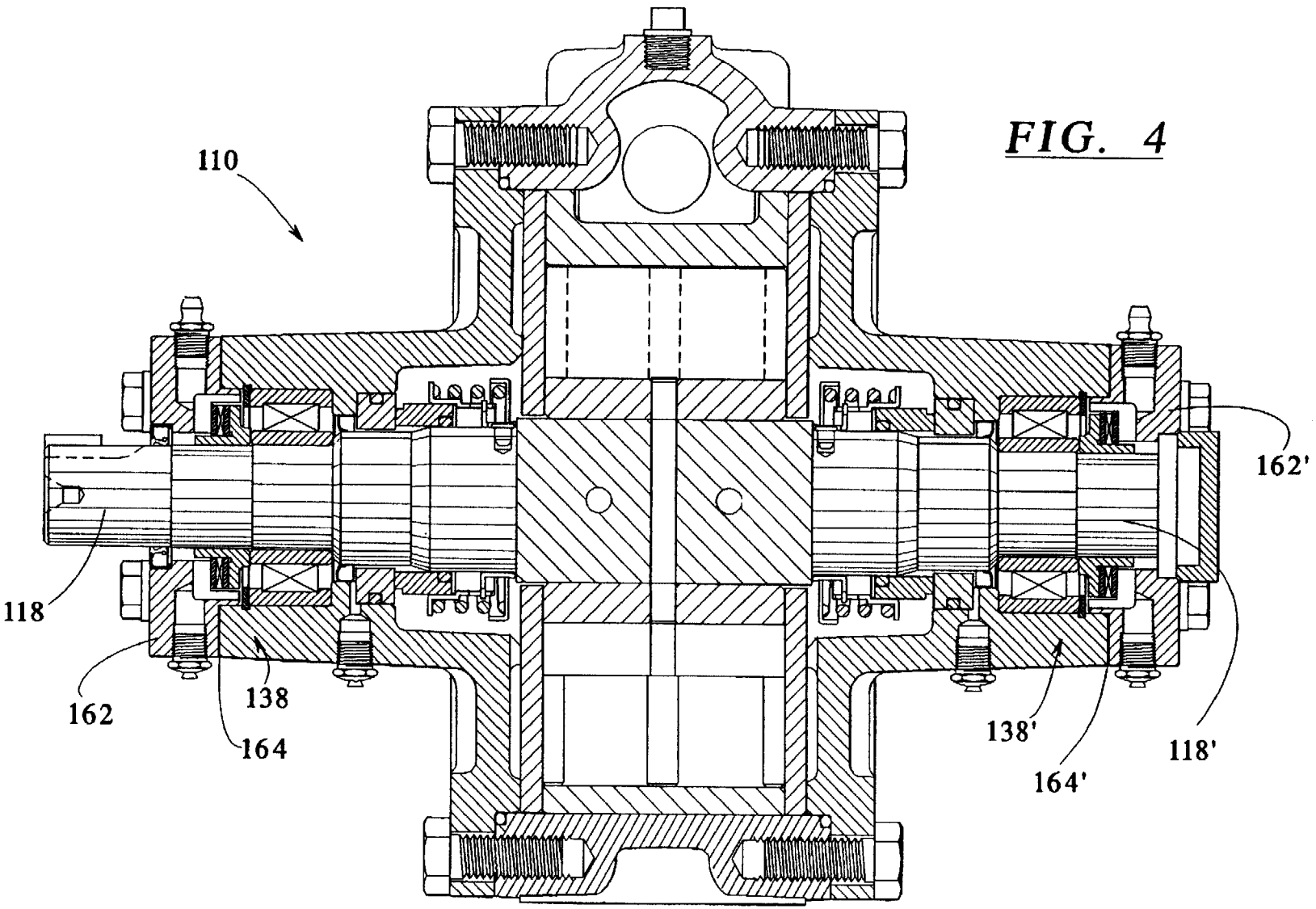
FIG. 4 is a sectional view of another pump according to the present invention, wherein the pump has a shaft with a single driving end.

The present invention provides an improved bearing arrangement which is suitable for a pump shaft configured with either two driving ends, as in FIGS. 1 and 3, or only one driving end, as in FIG. 4.

Figure 2:
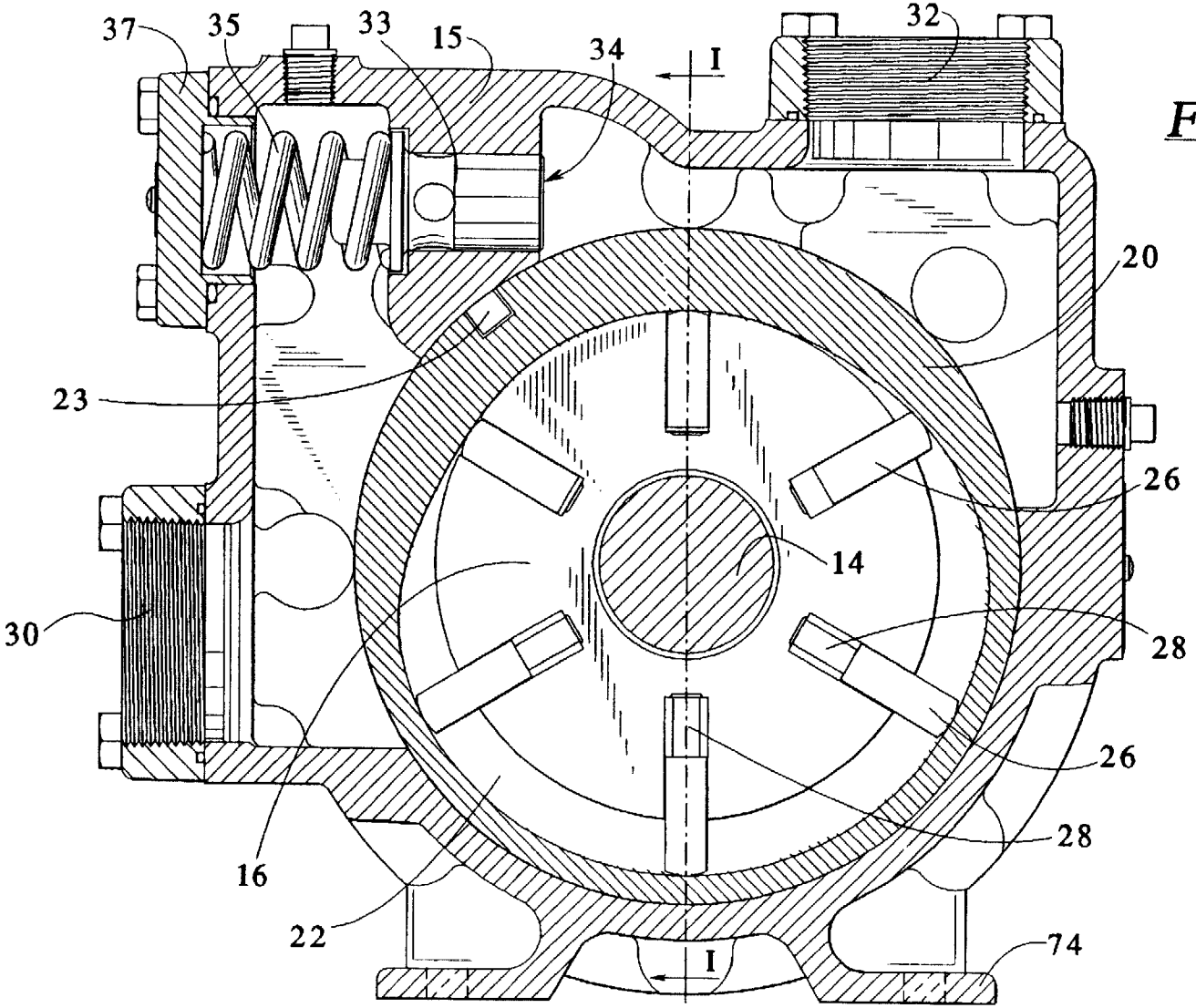
FIG. 2 is a sectional view of the pump of FIG. 1, the section being taken generally along line II—II of FIG. 1.

Referring to FIGS. 1 and 2, a vane pump 10 is provided, generally having a housing including a housing head 12, 12' at each end. The pump 10 also includes a shaft 14 and pumping components, such as a rotor 16, cam 20, drivers 28 and vanes 26. In the embodiment of FIGS. 1–3, the pump 10 is generally symmetrical, having opposite sides which mirror each other. Furthermore, in this embodiment, the shaft 14 has dual drive ends. Part numbers indicated by a prime (') herein refer to parts on the right side of FIGS. 1 and 3 having a symmetrical counterpart on the left of these Figures. The shaft 14 and rotor 16 are rotatable within the cam 20. The head 12 is preferably made of multiple components including first and second sides 13, 13' and bolted to a central housing 15. These components are bolted together. In the dual-drive ended embodiment of FIGS. 1 and 3, the shaft 14 has a first shaft end 18 and a second shaft end 18', each extending from the head 12 for connection to a drive system (not shown), such as an engine power take-off system of a motor vehicle. The rotor 16 is secured to the shaft 14 for rotation therewith.

As illustrated in FIG. 2, an generally annular cam 20 surrounds the rotor 16. The cam 20 has a varying wall thickness, defining a crescent-shaped pumping cavity 22 between the cam 20 and the rotor 16. The cam 20 is secured relative to the pump housing 15 by a cam key 23. The pumping cavity 22 is further defined by a pair of sideplates 24 at either side of the rotor 16 (FIG. 1). A plurality of slidable vanes or blades 26 are radially disposed in the rotor 16 at regularly-spaced angles. Opposite pairs of blades 26 are connected by a solid rod-like blade driver 28. Each blade driver 28 is slidably disposed diametrically through the rotor 16 and shaft 14. Each blade driver 28 holds the associated blades 26 so that an outer edge of each blade 26 is maintained against the cam 20 throughout a revolution of the rotor 16. Thus, as the rotor 16 rotates, fluid is carried between the blades 26 from an inlet port (not shown) at one end of the pumping cavity 22 to an outlet port (not shown) at an opposite end of the cavity, resulting in a pumping of the fluid from an inlet 30 in the housing to an outlet 32. Various mechanisms can be used to move the blades 26, such as by fluid hydraulic means or by mechanical means, such as an internal cam ring (not shown).

Optionally, the pump 10 may include a relief valve 34 to prevent damage within the pump 10 due to an excessive pressure differential. Such a pressure differential might result from an inadvertently blocked flow path. If this occurs, the relief valve 34 opens, recirculating fluid from the outlet 32 to the inlet 30, preventing an excessive pressure or vacuum build-up. The valve 34 includes a plunger 33 which is biased by a spring 35 in a normally closed position. A valve cover 37 is secured to the housing which can be removed for disassembly or maintenance of the valve 34.

Referring to FIG. 1, the shaft extends through the housing 12, 12' in a preferably symmetrical manner, the first drive end 18 and opposite second drive end 18' projecting outwardly. The rotor 16 is secured to the shaft 14 between the dual drive ends 18, 18'. On respective sides of the rotor 16, the pumping chamber is sealed by first and second rotational inner seal assemblies, 36 and 36', respectively, positioned in the heads 12 and 12'. Also, outwardly from each inner seal, each first and second shaft end 18 and 18' rotationally rides in a respective bearing arrangement 38, 38'.

As shown in both FIGS. 1 and 3, the first and second bearing arrangements 38, 38' each include a radial main bearing 40, 40' including an inner race 42, 42' and an outer race 44, 44'. Bearing rollers 43, 43' ride between the races 42, 42' and 44, 44'. Each inner race 42, 42' is mounted for rotational movement with the respective shaft end 18, 18'. For example, the inner race 42, 42' may be press-fit or slipped onto the shaft end 18, 18' or, in an embodiment, the race 42, 42' may be integral to the shaft 18, 18'. Each outer race 44, 44' fits closely into each head 12, 12', and is retained therein by a respective retainer ring 46, 46'. Each retainer ring 46, 46' resides in an annular groove 48, 48' in each head 12 and 12' and presses against a side of the outer race 44, 44' facing away from the rotor 16.

Adjacent to each radial main bearing 40, 40', and at a side thereof facing away from the rotor 16, an annular thrust bearing mounting ring 50, 50' is slipped onto the respective shaft end 18, 18' so that it contacts against the inner race 42, 42' of the main bearing 40, 40'. Each mounting ring 50, 50' is shaped to define a thrust face 52, 52' that is perpendicular to the shaft axis, facing away from the rotor 16.

Still referring to FIGS. 1 and 3, each bearing arrangement 38, 38' includes an annular thrust bearing assembly 54, 54' which has an inner race or thrust washer 56, 56', an outer race or thrust washer 58, 58', and a thrust bearing 60, 60' disposed therebetween. The inner washer 56, 56' contacts against the thrust face 52, 52' of the mounting ring 50, 50'. The outer washer 58, 58' faces away from the rotor 16. A thrust bearing cap 62, 62' is bolted to each end of the head 12, 12' contacting against the outer thrust absorbing washer 58, 58' of the respective thrust bearing assembly 54, 54'.

Each thrust bearing assembly 54, 54' is thereby held between its respective bearing cap 62, 62' and mounting ring 50, 50'. A shim 64, 64' having a selected thickness is preferably installed between each bearing cap 62, 62' and head 12, 12' to hold the bearing arrangements 38, 38' at close internal pump clearances. Thus, the rotor 16 and blades 26 can be axially centered to proper clearances in the pump 10 for optimum pump performance, even during operation under undesired axial loading. More particularly, the rotor 16 and blades 26 are prevented from moving axially within the cam 20, which would result in undesirable wearing of the rotor 16 against one of the sideplates 24. In an embodiment, multiple shims 64 or 64' could be provided between the bearing cap 62, 62' and the housing 12 and 12'. In this case, the combined thicknesses are selected to properly center the internal components.

Each bearing cap 62, 62' includes a seal 66, 66' disposed around the shaft 14. Furthermore, each bearing cap 62, 62' is removable for access to the bearing arrangement 38, 38'. Also, this configuration promotes easy assembly of the pump 10. The shaft 14 preferably includes sections of decreasing diameter outwardly from the rotor 16. Such a shaft shape permits the inner seal assembly 36, 36', main bearing 40, 40', mounting ring 50, 50' and outer seal 66, 66' to be consecutively removed or installed from each respective side. Furthermore, the shaft diameter decreases at the portion on which the inner race 42, 42' of the radial main bearing 40, 40' is secured. This forms a ridge 68, 68' on each shaft drive end 18, 18' to transmit axial thrust forces from the shaft 14 outwardly to the inner race 42, 42', the axial thrust force being subsequently transmitted to and constrained by the associated thrust bearing assembly 54, 54'.

As mentioned, because of the symmetrical configuration, the pump 10 can be driven from either shaft drive end 18, 18' by providing rotational power to a selected shaft drive end 18, 18'. Radial loads are carried by the main bearings 40, 40'. Any axial load transmitted through the shaft 14 is borne by one of the thrust bearing assemblies 54, 54'. Specifically, as illustrated in FIG. 1, an external axial load A (transmitted from left to right) is transmitted through the shaft 14 to the ridge 68' of the second shaft drive end 18', to the inner race 42' of the second radial main bearing 40', to the mounting ring 50', to the second thrust bearing assembly 54'. Conversely, an external axial load B (transmitted from right to left) is transmitted through the shaft 14 to the ridge 68 of the first shaft drive end 18, to the inner race 42 of the first main bearing 40, to the mounting ring 50, and to the first thrust bearing assembly 54.

As shown in FIGS. 1 and 3, first and second lubrication cavities 70, 70' are provided, one being disposed respectively adjacent the first and second bearing assemblies 54, 54'. Each lubrication cavity 70, 70' has a grease nipple 72, 72' through which lubricant can be added to the cavity 70, 70'. Each cavity 70, 70' is exposed to the respective thrust bearing assembly 54, 54' and over the mounting ring 50, 50' to the main bearing 40, 40', providing lubricant to these components. Each lubrication cavity 70, 70' also extends to the outer shaft seal 66, 66' to lubricate it as well. Shaft seals 67 and 67' are disposed around the shaft 18, 18' axially inward of the bearing arrangement 38, 38'. Lubrication is contained by the shaft seals 66, 66' and 67, 67'.

The pump housing 15 may also include a flange 74 which serves as a mount for installing the pump 10 for a particular application.

Now turning to FIG. 4, in accordance with the present invention, a pump 110 may be provided having a single drive end. The pump 110 is substantially the same as the pump 10 described with reference to FIGS. 1–3, except that the pump 110 includes a shorter shaft end 118' which is enclosed by a closed bearing cap 162'. The pump 110 is drivable only at the opposite shaft end 118, which extends through a bearing cap 162. In the pump of FIG. 4, the shaft ends 118 and 118' are radially and axially rotationally supported by bearing arrangements 138, 138' and the internal components can be axially adjusted by shims 164, 164' in the same manner as previously described.

In another embodiment, not illustrated, each bearing cap has an annular threaded portion by which the bearing cap is threaded to the housing. This threaded engagement between the bearing cap and the housing secures the bearing cap and retains the thrust bearing assembly in position. This embodiment provides an evenly distributed force against the thrust bearing assembly, eliminating any need for setting bolt torques. Also, this embodiment allows easy adjustment of internal clearances by rotating the respective end caps. A set screw can be provided at an outer lip of each bearing cap to hold the desired position of the bearing cap.

It should be understood that various changes and modifications to the presently preferred embodiments will be apparent to those skilled in the art. For example, the shaft could be comprised either by piece or multiple components, such as separate drive ends each joined together or to the rotor. Furthermore, the bearing arrangement of the present invention could be utilized on a pump having a pumping component other than a rotor, such as a reciprocating piston pump, scroll pump, impeller, etc. Such changes and modifications may be made without departing from the spirit and scope of the present invention and without diminishing its attendant advantages. Therefore, the appended claims are intended to cover such changes and modifications.

What is claimed is:

1. An improved pump of the type having a housing, a shaft rotationally disposed within the housing having first and second shaft ends, a pumping component secured between the first and second shaft ends, the improvement comprising:

first and second bearing caps, the bearing caps being secured to the housing; and first and second bearing assemblies rotationally supporting the first and second shaft ends, respectively, each bearing assembly having:

a main radial bearing having an inner race integral or secured to the shaft;

a mounting ring around the shaft adjacently contacting the inner race;

a thrust bearing assembly having a rotatable inner thrust washer contacting the mounting ring, a static outer thrust washer supported by an associated one of the bearing caps in a fixed manner relative to said housing, and a thrust bearing disposed between the inner and outer thrust washers, each bearing cap retaining supporting the respective thrust bearing against outer race toward the respective mounting ring.

2. The pump according to claim 1, the improvement further comprising:

at least one first and second shim, each shim being disposed between a respective one of the bearing caps and the housing, the shims having selected thickness suitable to generally center the pumping component within the housing.

3. The pump according to claim 1, the improvement further comprising:

first and second outer shaft seals, the first and second outer shaft seals being disposed in the first and second bearing caps, respectively, each outer shaft seal being sealably disposed around the shaft.

4. The pump according to claim 1, wherein the first shaft end extends through the first bearing cap and the second shaft end is covered by the second bearing cap.

5. The pump according to claim 1, wherein the first and second shaft ends extend through the first and second bearing caps, respectively.

6. The pump according to claim 1, the improvement further comprising:

first and second seal assemblies, the first and second seal assemblies being sealably disposed around the shaft between the pumping component and the respective bearing assemblies.

7. The pump according to claim 1, the improvement further comprising:

a lubrication cavity extending across the thrust bearing assembly and the main radial bearing.

8. The pump according to claim 1, wherein the pumping component is a rotor having radially slidable blades, fluid being carried between the blades through a generally crescent-shaped pumping cavity.

9. A pump comprising:

a housing;

a shaft rotationally disposed through the housing and having a pair of oppositely directed shaft ends, the shaft having an axis;

a pumping component secured between the shaft ends within the housing, the pumping component causing fluid to be pumped when rotated;

oppositely arranged first and second bearing arrangements, each bearing arrangement supporting one of said shaft ends, each bearing arrangement comprising:

a radial bearing having an inner race mounted for movement in unison with the shaft and an outer race disposed against the housing; and a thrust bearing assembly for receiving thrust loads from the shaft via the radial bearing inner race through means mounted between the thrust bearing assembly and radial bearing, the thrust bearing assembly being supported against the housing so that each of the thrust bearing assemblies is capable of bearing a respectively opposed unidirectional axial load in only an outwardly direction, each of the thrust bearing assemblies being axially adjustable.

10. The pump according to claim 9, further comprising:

a retainer ring which fits in an annular groove in the housing to retain the outer race in position.

11. The pump according to claim 9, further comprising:

a first and second lubrication cavity, each lubrication cavity being disposed adjacent a respective bearing arrangement to provide lubricant to the thrust and main bearings.

12. The pump according to claim 9, further comprising:

a first and second seal assembly, each seal assembly being disposed around each shaft end between the pumping component and the respective bearing assembly to seal a fluid being pumped.

13. The pump according to claim 9, wherein the pumping component includes a rotor having radially movable vanes, a pumping cavity being defined around the rotor within which the rotor rotates, each blade moving as the rotor rotates to closely follow a wall of the cavity, fluid being carried between the blades from one end the cavity to another as the rotor rotates.

14. The pump according to claim 9, wherein said means further comprises:

an annular mounting ring around the shaft, the mounting ring being in contact between the inner race and the thrust bearing assembly.

15. The pump according to claim 14, wherein each mounting ring contacts a side of the inner race away from the pumping component, and wherein the thrust bearing assembly contacts a side of the mounting ring away from the pumping component.

16. The pump according to claim 14, wherein each mounting ring has a thrust face facing toward and contacting against the thrust bearing assembly, the thrust face being perpendicular to an axis of the shaft.

17. The pump according to claim 14, wherein the thrust bearing assembly includes:

an inner thrust washer contacting the mounting ring;

a outer thrust washer fixed relative to the housing;

a thrust bearing disposed between the thrust absorbing washers.

18. A pump comprising:

a housing;

a shaft rotationally disposed through the housing and having a pair of oppositely directed shaft ends, the shaft having an axis;

a pumping component secured between the shaft ends within the housing, the pumping component causing fluid to be pumped when rotated;

first and second bearing arrangements, each bearing arrangement supporting one of said shaft ends, each bearing arrangement comprising;

a radial bearing having an inner race mounted for movement in unison with the shaft and an outer race disposed against the housing; and a thrust bearing assembly for receiving thrust loads from the shaft via the radial bearing inner race, the thrust bearing assembly being supported against the housing, each thrust bearing assembly comprising:

an annular mounting ring around the shaft, the mounting ring being in contact between the inner race and the thrust bearing assembly:

an inner thrust washer contacting the mounting ring;

an outer thrust washer fixed relative to the housing;

a thrust bearing disposed between the thrust absorbing washers; and first and second bearing caps, each cap being secured to the housing, each bearing cap contacting against a respective outer thrust washer, retaining an axial position of the bearing assembly.

19. The pump according to claim 18, further comprising:

at least one shim disposed between one of the bearing caps and the housing, the shim having a thickness selected to axially center the pumping component relative to the housing.

20. The pump according to claim 18, wherein the first shaft end extends through the first bearing cap.

21. The pump according to claim 18, wherein the first and second shaft ends extend respectively through the first and second bearing caps.

22. The pump according to claim 18, wherein each bearing cap includes: a seal disposed around the respective shaft end.

23. The pump according to claim 18, wherein the housing includes an inner shaft seal, disposed around the respective shaft end between the seal assembly and the main radial bearing to retain the lubricant between the inner and outer shaft seals.

* * * * *